US009038737B2

(12) United States Patent
Hallundbæk et al.

(10) Patent No.: US 9,038,737 B2
(45) Date of Patent: May 26, 2015

(54) INFLOW CONTROL DEVICE

(71) Applicant: WELLTEC A/S, Allerød (DK)

(72) Inventors: Jørgen Hallundbæk, Græsted (DK); Tomas Sune Andersen, Helsingør (DK)

(73) Assignee: WELLTEC A/S, Allerød (DK)

( * ) Notice: Subject to any disclaimer, the term of this patent is extended or adjusted under 35 U.S.C. 154(b) by 0 days.

(21) Appl. No.: 14/349,224

(22) PCT Filed: Oct. 26, 2012

(86) PCT No.: PCT/EP2012/071268

§ 371 (c)(1),
(2) Date: Apr. 2, 2014

(87) PCT Pub. No.: WO2013/060847

PCT Pub. Date: May 2, 2013

(65) Prior Publication Data

US 2015/0034334 A1 Feb. 5, 2015

(30) Foreign Application Priority Data

Oct. 28, 2011 (EP) ..... 11187091

(51) Int. Cl.
*E21B 34/12* (2006.01)
*E21B 43/08* (2006.01)
(Continued)

(52) U.S. Cl.
CPC ..... *E21B 34/12* (2013.01); *E21B 34/08* (2013.01); *E21B 43/12* (2013.01); *E21B 2034/002* (2013.01); *E21B 43/08* (2013.01)

(58) Field of Classification Search
CPC ..... E21B 34/00; E21B 34/08; E21B 34/12; E21B 2034/002; E21B 43/08; E21B 43/12
USPC ..... 166/116, 330, 169, 205, 242.1, 373; 251/315.16, 315.01, 315.1, 345; 137/15.22, 315.17
See application file for complete search history.

(56) References Cited

U.S. PATENT DOCUMENTS 3,518,742 A * 7/1970 Krosoczka et al. ..... 29/890.125
4,782,896 A * 11/1988 Witten ..... 166/116
(Continued)

FOREIGN PATENT DOCUMENTS

WO WO 2006/064215 6/2006
WO WO 2006/090168 8/2006
WO WO 2009/103036 8/2009

OTHER PUBLICATIONS

Notification Concerning Transmittal of International Preliminary Report on Patentability, International Preliminary Report on Patentability and Written Opinion for corresponding PCT/EP2012/071268, issued Apr. 29, 2014, 7 pages.
(Continued)

*Primary Examiner* — Daniel P Stephenson
(74) *Attorney, Agent, or Firm* — Nixon & Vanderhye, P.C.

(57) ABSTRACT

The present invention relates to an inflow control device for controlling the flow of fluid into a well tubular structure arranged in a borehole, comprising a tubular part for mounting as part of the well tubular structure, an aperture provided in a wall of the tubular part, and a hollow valve member rotatably received inside the tubular part, the hollow valve member comprising an orifice in a wall thereof, and an outer surface of the hollow valve member being spherical and the orifice being adapted to fluidly communicate with the aperture when the inflow control device is in an open position, whereby the aperture is in fluid communication with an inside of the tubular part, wherein the hollow valve member comprises a spherical first valve part and a spherical second valve part adapted to be assembled inside the tubular part. The present invention furthermore relates to a method of assembling an inflow control device according to the invention and to a completion system comprising an inflow control device according to the invention.

14 Claims, 3 Drawing Sheets

(51) Int. Cl.

| | |
|---|---|
| ***E21B 34/08*** | (2006.01) |
| ***E21B 43/12*** | (2006.01) |
| *E21B 34/00* | (2006.01) |

(56) References Cited

U.S. PATENT DOCUMENTS

| | | | | |
|---|---|---|---|---|
| 4,921,044 | A * | 5/1990 | Cooksey | 166/116 |
| 5,979,873 | A * | 11/1999 | Wu | 251/315.16 |
| 6,471,183 | B2 * | 10/2002 | Roszkowski et al. | 251/315.16 |
| 7,506,690 | B2 * | 3/2009 | Kelley | 166/372 |
| 7,836,909 | B2 * | 11/2010 | Church | 137/15.22 |
| 2008/0315144 | A1 * | 12/2008 | Thomas | 251/315.1 |
| 2009/0045368 | A1 | 2/2009 | Cowie et al. | |
| 2009/0071658 | A1 | 3/2009 | Reid et al. | |
| 2010/0084133 | A1 | 4/2010 | Weirich et al. | |
| 2011/0073308 | A1 | 3/2011 | Assal et al. | |

OTHER PUBLICATIONS

International Search Report for PCT/EP2012/071268 mailed Nov. 16, 2012.

Written Opinion of the International Searching Authority mailed Nov. 16, 2012.

* cited by examiner

INFLOW CONTROL DEVICE

This application is the U.S. national phase of International Application No. PCT/EP2012/071268 filed 26 Oct. 2012 which designated the U.S. and claims priority to EP 11187091.1 filed 28 Oct. 2011, the entire contents of each of which are hereby incorporated by reference.

FIELD OF THE INVENTION

The present invention relates to an inflow control device for controlling the flow of fluid into a well tubular structure arranged in a borehole. The present invention furthermore relates to a method of assembling an inflow control device according to the invention and to a completion system comprising an inflow control device according to the invention.

BACKGROUND ART

In the completion of hydrocarbon-producing wells, a well tubular structure, such as a string of casing modules, may be inserted into the borehole and optionally cemented in place. The well tubular structure may comprise various casing modules having different functionalities, such as modules comprising an annular barrier or packer, modules for injecting a fluid into the surrounding formation, modules comprising screens, inflow control modules comprising sliding sleeves, etc.

These casing modules are provided as part of the well tubular structure and are positioned downhole. To operate the casing modules, such as a sliding sleeve of an inflow control modules, a downhole tool may be lowered into the well to engage and position the sliding sleeve according to specific production needs.

A drawback of a sliding sleeve is that fluid particles, such as scales, get stuck in the track wherein the sliding sleeve has to slide. If, for example, the sliding sleeve is in a specific position for a longer period of time, scales build up in the vacant and exposed part of the track. Further, it is important that the inside surface of the casing is continuous and smooth without flow restrictions and unnecessary variations in the inner diameter.

SUMMARY OF THE INVENTION

It is an object of the present invention to wholly or partly overcome the above disadvantages and drawbacks of the prior art. More specifically, it is an object to provide an improved inflow control device having a simple construction and good sealing characteristics without restricting the flow inside the well tubular structure.

The above objects, together with numerous other objects, advantages, and features, which will become evident from the below description, are accomplished by a solution in accordance with the present invention by an inflow control device for controlling the flow of fluid into a well tubular structure arranged in a borehole, comprising:

- a tubular part for mounting as part of the well tubular structure,
- an aperture provided in a wall of the tubular part, and
- a hollow valve member rotatably received inside the tubular part, the hollow valve member comprising an orifice in a wall thereof, wherein an outer surface of the hollow valve member is spherical and the orifice is adapted to fluidly communicate with the aperture when the inflow control device is in an open position, whereby the aperture is in fluid communication with an inside of the tubular part.

By the use of a rotating valve member, build-up of scales in the track of the valve member may be avoided because the valve member occupies the track continuously and the track is never laid bare, as would be the case for a sliding sleeve.

By having a spherical hollow valve member, the friction during rotation of the valve may be substantially reduced.

In an embodiment, the hollow valve member may comprise a spherical first valve part and a spherical second valve part adapted to be assembled inside the tubular part.

Further, the first valve part and the second valve part may each constitute substantially one half of the hollow valve member.

Moreover, the two valve parts may be joined along a valve parts interface constituting a dividing line of the hollow valve member which is aligned with two opposite orifices when the inflow control device is in an open position.

Also, a recess having a spherical surface may be provided in the tubular part to accommodate the hollow valve member, the recess preventing the hollow valve member from moving in a longitudinal direction of the tubular part.

Hereby, the first valve part and the second valve part may be inserted into the tubular part one by one and assembled inside the tubular part to provide a hollow valve member without the need for spacers or other additional components for joining the first and the second valve parts.

By the hollow valve member being spherical and constituted by a first and a second valve part and the recess being spherical, the outer diameter of the hollow valve member may exceed a smallest inner diameter of the tubular part, and the inner diameter of the hollow valve member may thus be the same as the smallest inner diameter of the tubular part. Thereby, the hollow valve member does not restrict the flow inside of the well tubular structure. At the same time, the hollow valve member may be assembled inside the tubular part.

By the first and the second valve parts constituting a substantially spherical, hollow valve member, the inflow control device may be constructed with a substantially tight fit between the first and the second valve parts to provide an inflow control device capable of withstanding pressure levels above those of traditional sliding sleeves or rotating sleeves.

Said hollow valve member may comprise four orifices in the wall thereof.

In an embodiment, four apertures may be provided in the wall of the tubular part.

Furthermore, the hollow valve member may have an inner diameter being substantially the same as or less than a smallest inner diameter of the tubular part.

The inflow control device as described above may further comprise a flow control valve for controlling the volumetric flow of fluid into the tubular part.

This flow control valve may be positioned upstream of the aperture provided in the wall of the tubular part.

In an embodiment, fluid channels may connect the flow control valve and the apertures.

Moreover, the hollow valve member may comprise a key hole for cooperating with a key tool adapted to rotate the hollow valve member between the open position and a closed position.

The inflow control device as described above may further comprise sealing elements provided in the wall of the tubular part encircling the apertures, the sealing elements being adapted to provide a sealing effect between the tubular part and the hollow valve member.

Said sealing elements may be o-rings.

By arranging the sealing elements in the wall of the tubular part having a spherical surface, each of the sealing elements may extend in only one plane and thus do not have to be curved in comparison with sealing elements used for sealing apertures in a sliding or rotating sleeve. The sealing elements utilised in embodiments of the present invention hereby provide an improved sealing effect between the tubular part and the hollow valve member, because the sealing elements obtain a tighter fit with the spherical surface of the hollow valve member. The tension provided by the material of the sealing elements itself is thus sufficient to provide the necessary sealing effect.

Additionally, a radius of the outer surface of the hollow valve member in a plane extending in the longitudinal direction may be substantially equal to a radius of the outer surface of the hollow valve member in a plane extending in a direction transversal to the tubular part.

Also, the hollow valve member may be made of a ceramic material.

The surface of the hollow valve member and/or the surface of the recess may be provided with a coating comprising carbon, such as graphene.

Further, the inflow control device as described above may comprise a screen module comprising a screen, the screen module being arranged in continuation of the tubular part as part of the well tubular structure.

The present invention further relates to a method of assembling an inflow control device as described above, comprising:

- positioning the first valve part in the recess inside the tubular part,
- rotating the first valve part in a plane extending in the longitudinal direction,
- positioning the second valve part in the recess inside the tubular part, and
- rotating the second valve part in a plane extending in the longitudinal direction, whereby the first valve part and the second valve part engage to form a hollow valve member.

Finally, the present invention relates to a completion system comprising an inflow control device as described above and a well tubular structure.

Said well tubular structure may comprise a casing module, such as a barrier module, comprising an annular barrier or packer, an injection module for injecting a fluid into the surrounding formation, and an inflow control module comprising inflow control modules comprising sliding sleeves or the like.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
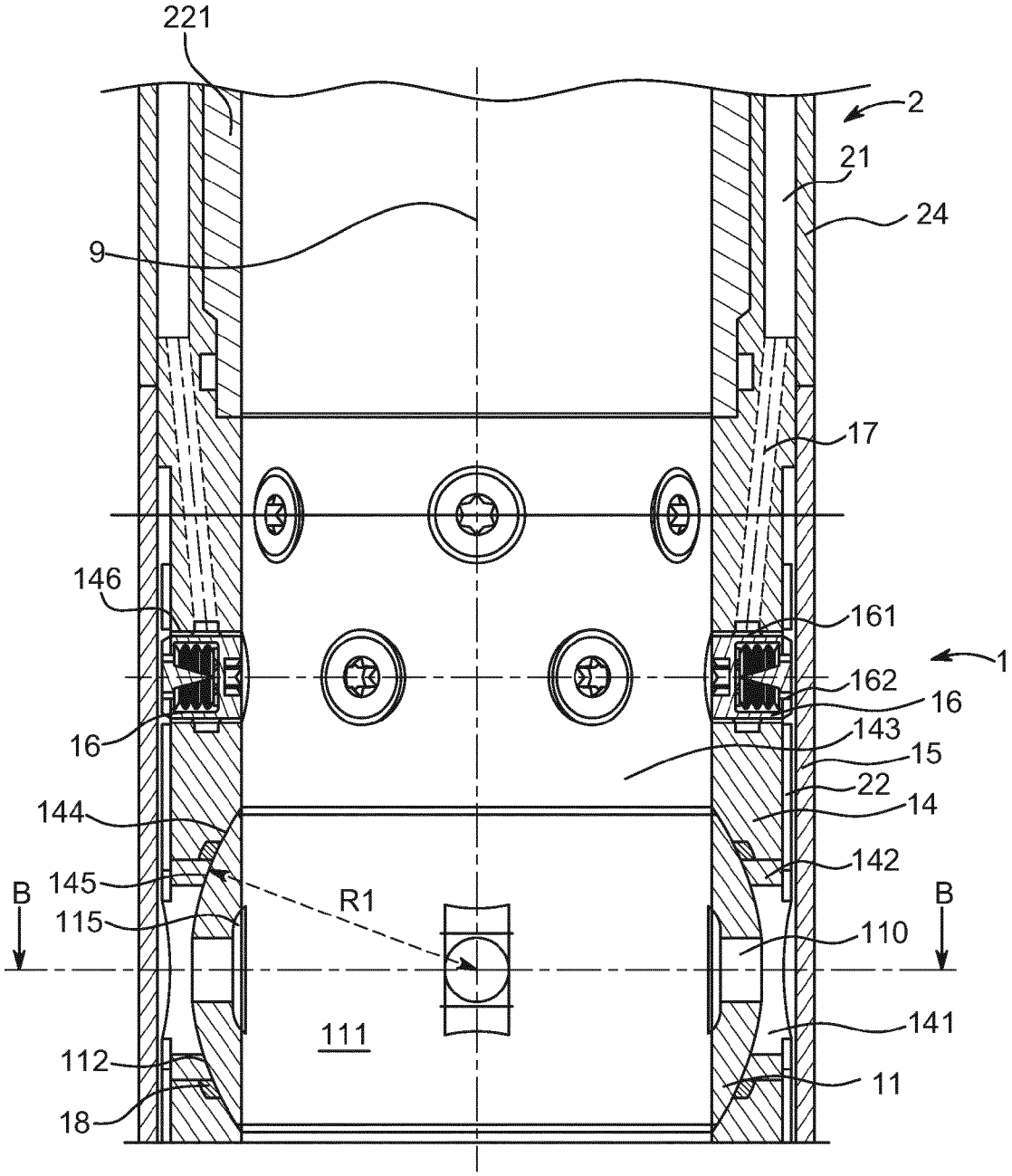
FIG. 1 shows a cross-section of the inflow control device in the longitudinal direction.
Figure 3:
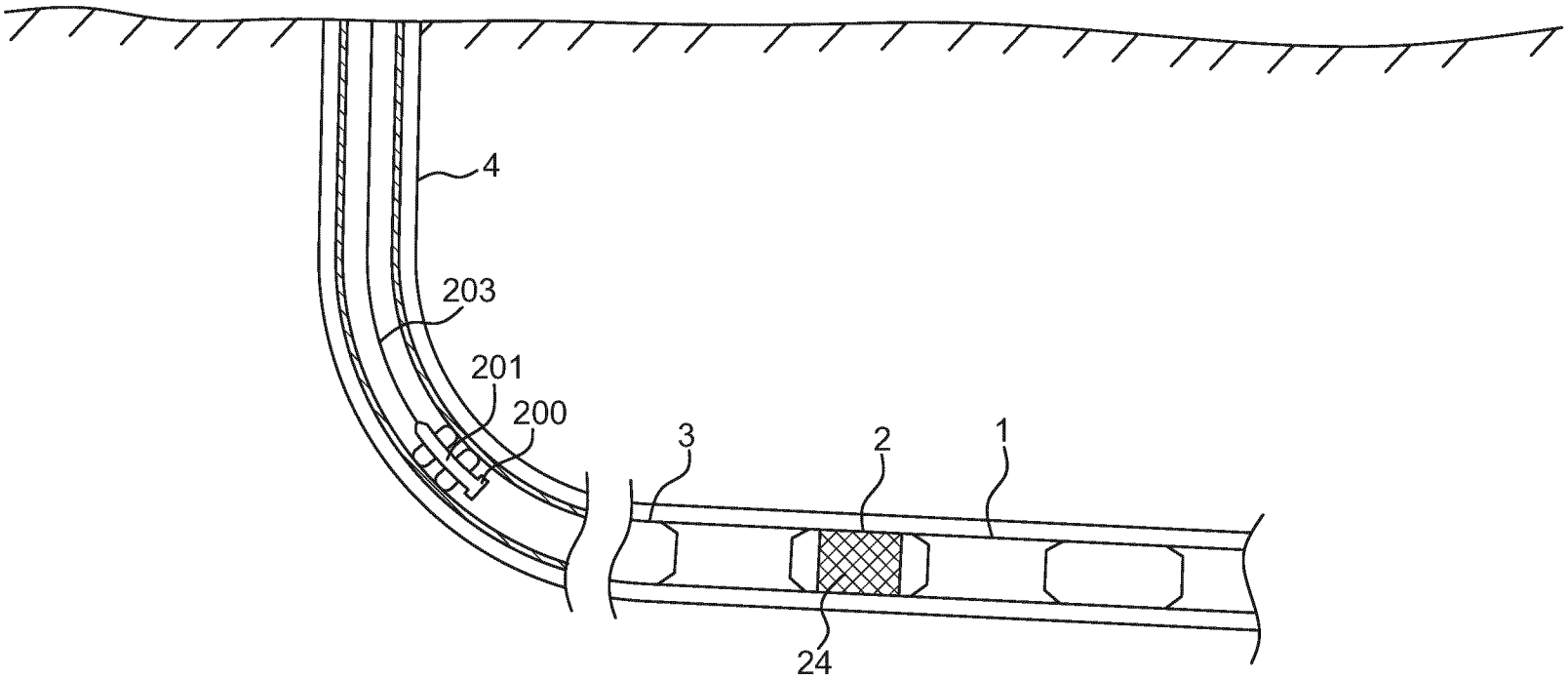
FIG. 3 shows a schematic diagram of a well tubular structure comprising one or more inflow control devices connected to other casing modules.

FIG. 1 and FIG. 3 show an inflow control device 1 for controlling the flow of fluid into a well tubular structure 3 arranged in a borehole 4. As shown in FIG. 1, the inflow control device comprises a tubular part 14 for being mounted as part of the well tubular structure 3 of FIG. 3, whereby fluid communication is established between an inside 143 of the inflow control device 1 and an inside of the remainder of the well tubular structure. Surrounding the tubular part 14, an outer pipe element 15 is provided. The tubular part 14 and the outer pipe element 15 together define a fluid flow path 22 between an outer surface of the tubular part 14 and an inner surface of the outer pipe element 15 and extend in a longitudinal direction 9 of the inflow control device 1. In a wall 142 of the tubular part 14, four apertures 141 are provided, whereby fluid may flow into the tubular part. The apertures are distributed along the circumference of the tubular part 14 and are surrounded by sealing elements 18. It is to be understood by those skilled in the art that another number of apertures, both higher and lower than that specified, is possible and is considered to be within the scope of the present invention.

To control the flow through the aperture 141, the inflow control device comprises a hollow valve member 11 rotatably received inside the tubular part. The hollow valve member 11 is received in a recess 144 for preventing the hollow valve member from moving in a longitudinal direction 9 of the tubular part. In the shown embodiment, the recess is milled into the well tubular structure. However, it is to be understood by those skilled in the art that the recess 144 may also be provided in an additional component (not shown in FIG. 1) positioned inside the tubular part or in numerous other ways without departing from the scope of the present invention.

The hollow valve member 11 comprises four orifices 110 extending between an outer surface 112 and a throughbore 111 of the hollow valve member. When the inflow control device 1 is in an open position, each of the orifices 110 are positioned adjacent one of the apertures 141, whereby fluid flow paths are provided through the apertures 141 via the orifices 110 and the throughbore 111 and into the inside 143 of the inflow control device. Hereby, fluid may flow past the inflow control device 1 and into the well tubular structure 3. It is to be understood by those skilled in the art that another number of orifices 110, both higher and lower than that specified, is possible and is considered to be within the scope of the present invention.

The outer surface 112 of the hollow valve member 11 and a surface 145 of the recess 144 are spherical, and the valve member thus constitutes a substantially spherical, hollow valve member 11 retained in a mating recess 144. In an alternative embodiment, the outer surface 112 of the hollow valve member 11 and a surface 145 of the recess 144 may be spheroid, whereby the valve member constitutes a substantially spheroid shaped, hollow valve member 11.

Figure 2:
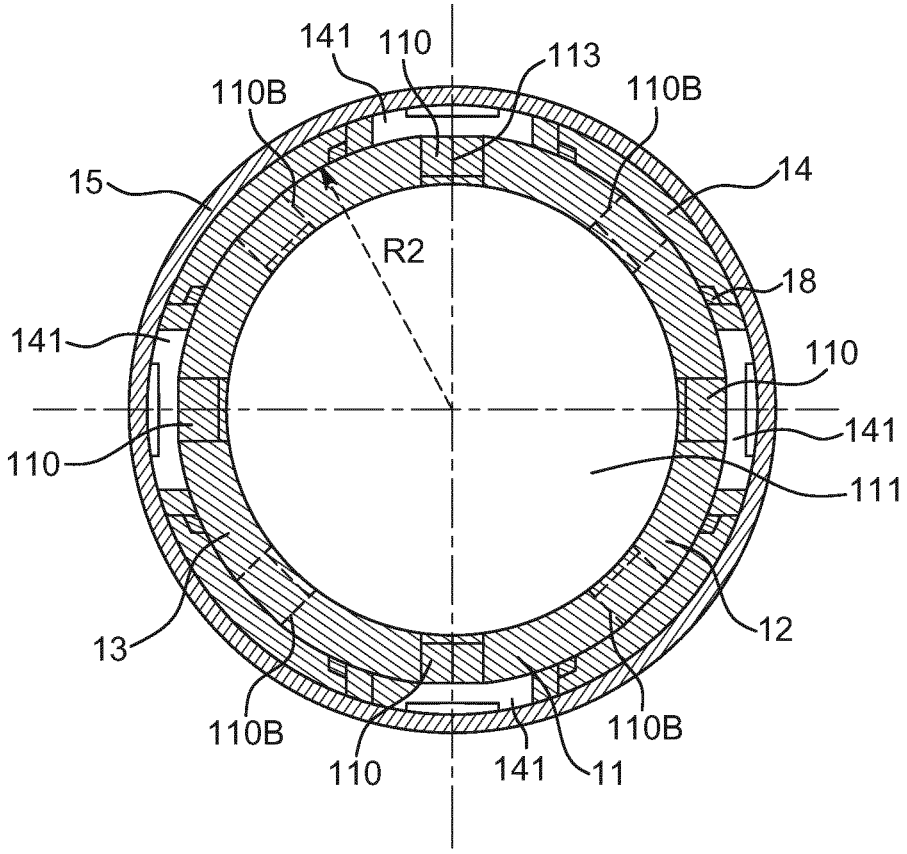
FIG. 2 shows a cross-section of the inflow control device along line BB in FIG. 1.

The tubular part 14 constitutes a housing for the hollow valve member 11 which is rotatably received within the tubular part 14. The hollow valve member may thus be rotated inside the tubular part between a closed position and an open position. In FIG. 1 and FIG. 2, the inflow control device is shown in the open position. Orifices indicated by the dotted lines 110B shown in FIG. 2 illustrate the position of the hollow valve member 11 when the inflow control device is in the closed position. In the closed position, each of the orifices 110 is positioned between two apertures.

To reduce frictional resistance, prevent wear of the inflow control device and enhance the ease of operation, the outer surface 112 of the hollow valve member and the surface 145 of the recess may be provided with a coating comprising carbon, such as graphene. The coating may be constituted by one or more layers of graphene, or other allotropes of carbon. Such coating may also be applied to other surfaces of the inflow control device to prevent fluid particles from getting stuck and reduce the likelihood of the inflow control device clogging. Additionally, the hollow valve member 11 may be manufactured from a ceramic material.

In the shown embodiment, the hollow valve member 11 comprises a first spherical valve part 12 and a second spherical valve part 13 adapted to be assembled inside the tubular part 14, as shown in FIG. 2. When joined inside the tubular part 14, the two valve parts 12, 13 constitute the hollow valve member. As can be seen, the hollow valve member is thus divided into two substantially equal halves, i.e. the first valve part 12 and the second valve part 13. The two valve parts 12, 13 are joined along a valve parts interface shown in FIG. 2 and indicated by reference numeral 113. The valve parts interface 113 constitutes a dividing line for the hollow valve member. As shown in FIG. 2, the valve parts interface 113 is aligned with two opposite orifices 110. Thus, when the hollow valve member 11 is in the open position, the valve parts interface 113 is positioned opposite two apertures 141. By contrast, when the hollow valve member 11 is in the closed position, the valve parts interface 113 is positioned between two apertures 141. Consequently, the valve parts interface 113 does not have to be fluid-tight, because when the inflow control device is in the closed position, the valve parts interface 113 is not in fluid communication with the apertures 141 due to the sealing elements 18 surrounding the apertures 114. When the inflow control device is in the open position and the valve parts interface 113 is positioned opposite apertures 141, it does not matter whether fluid enters through the valve parts interface 113. Due to the valve parts interface 113 not having to be fluid-tight, tolerances on the valve parts 12, 13 may be reduced, and assembly of the inflow control device may be accomplished more easily. It is to be understood by those skilled in the art that another number of valve parts, both higher and lower than that specified, is possible and is considered to be within the scope of the present invention. Each of the first and the second valve parts 12, 13 may comprise mating engagement means (not shown) for keeping the valve parts 12, 13 together inside the tubular part 14. Such engagement means may provide either a permanent or a releasable connection between the two valve parts 12, 13.

As shown in FIG. 1, the hollow valve member 11 comprises one or more key holes 115 for rotating the hollow valve member 11 between the closed and the open position. The one or more key holes 115 is/are comprised by indentations surrounding the orifices 110 and adapted for cooperating with a key of a key tool 200, as shown in FIG. 3. The key tool 200 is inserted in the well tubular structure 3 and may be operated by wireline 203 or other means known to the person skilled in the art. The key tool is adapted to rotate the hollow valve member between the open position and a closed position. The key tool may be part of a tool string comprising a downhole tractor for propelling the tool string inside the well tubular structure. The tool string may also comprise other tools, such as a logging tool for locating the inflow control device, a visual inspection tool for determining the position of the inflow control device, etc.

The inflow control device 1 further comprises one or more flow control valves 16 for controlling the volumetric flow of fluid into the tubular part 14. The one or more flow control valves 16 are arranged in mating throughbores 146 in the wall 143 of the tubular part 14. An inlet 161 of the inflow control valve 16 is in fluid communication with a valve inflow path 17 provided in the wall 143 of the tubular part 14. An outlet 162 of the inflow control valve 16 is in fluid communication with the fluid flow path 22 between the tubular part 14 and the outer pipe element 15 and thus in fluid communication with the inside of the tubular part when the inflow control device is in its open position. Hereby, the flow of fluid towards the inflow control device is controlled by the inflow control valve, and the inflow control valve may thus control the flow of fluid into the tubular part and into the well tubular structure.

In operation, fluid enters the inflow control device 1 through the valve inflow path 17. From the valve inflow path 17, a controlled amount of fluid passes the flow control valve 16 to enter the fluid flow path 22. From the fluid flow path 22, the fluid enters the apertures 141 and advances through the orifices 110 when the inflow control device is in an open position. If the inflow control device is in the closed position, apertures 141 are blocked.

As shown in FIG. 3 and FIG. 1, the inflow control device may further comprise a screen module 2 arranged in continuation of the tubular part as part of the well tubular structure. As shown in FIG. 1, the screen module comprises a screen 24 and a tubular part 221 being connected to the tubular part 14 of the inflow control device. Further, a screen flow path 21 is fluidly connected to the valve inflow path 17. Hereby, fluid surrounding the well bore structure may enter through the screen module and flow from the screen module and into the inflow control device 1. It is to be understood by those skilled in the art that the inflow control device may be connected with numerous other casing modules of varying functionality without departing from the scope of the present invention.

In an alternative embodiment, the inflow control device may be in direct fluid communication with an annulus surrounding the inflow control device. In such embodiment, a screen or filtering device (not shown) may be provided directly opposite the apertures 141 to filter fluid flowing towards the apertures.

During manufacturing, assembly of the inflow control device may be accomplished by moving the first valve part 12 through the inside 143 of the tubular part 14 and positioning the first valve part 12 in the recess 144 such that the outer surface 112 of the first valve part 12 abuts the surface 145 of the recess 144. Then the first valve part is rotated substantially ninety degrees in a plane extending in a direction longitudinal to the tubular part 14, whereby the first valve part arrives at a position, as shown in FIG. 1 and FIG. 2. Subsequently, the second valve part 13 is positioned in the recess 144 and rotated in a manner similar to that described above. As the second valve part is rotated substantially ninety degrees, the two valve parts 12, 13 engage to provide the hollow valve member. As previously described, the valve parts 12, 13 may comprise engagement means engaging as the second valve part 13 is rotated in place. By the method of assembly described above, the outer diameter of the valve parts 12, 13, and thus of the hollow valve member 11, may exceed the inner diameter of part of the tubular part.

By dividing the hollow valve member into two halves, the housing, i.e. the tubular part 14, of the inflow control device can be made as one component, e.g. cold drawn, making the inflow control device simpler in construction and increasing the sealing characteristics substantially. Furthermore, the hollow valve member can be designed to have an inner diameter which is substantially the same as the smallest inner diameter of the tubular part, and thus, the inflow control device does not restrict the flow inside the well tubular structure.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

In the event that the tools are not submergible all the way into the casing, a downhole tractor can be used to push the tools all the way into position in the well. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. An inflow control device configured to control the flow of fluid into a well tubular structure arranged in a borehole, comprising:

a hollow valve member having a spherical outer surface;

a tubular part for mounting as part of the well tubular structure located downhole;

an aperture provided in a wall of the tubular part; and an orifice provided in a wall of the hollow valve member; wherein:

the tubular part is configured to receive a hollow valve member, the hollow valve member being a separate structure;

the hollow valve member is configured to be received by the tubular part downhole and rotated therein;

the orifice is adapted to fluidly communicate with the aperture when the inflow control device is in an open position, whereby the aperture is in fluid communication with an inside of the tubular part; and the hollow valve member comprises a spherical first valve part and a spherical second valve part adapted to be assembled together to form the hollow valve member after being received as separate parts by the tubular part and respectively rotated therein to a preselected first valve part assembly position and a second valve part assembly position inside the tubular part.

2. An inflow control device according to claim 1, wherein the first valve part and the second valve part each constitute substantially one half of the hollow valve member.

3. An inflow control device according to claim 1, wherein the two valve parts are joined along a valve parts interface constituting a dividing line of the hollow valve member which is aligned with two opposite orifices when the inflow control device is in an open position.

4. An inflow control device according to claim 1, wherein a recess having a spherical surface is provided in the tubular part to accommodate the hollow valve member, the recess preventing the hollow valve member from moving in a longitudinal direction of the tubular part.

5. An inflow control device according to claim 1, wherein the hollow valve member has an inner diameter being substantially the same as or less than a smallest inner diameter of the tubular part.

6. An inflow control device according to claim 1, further comprising a flow control valve for controlling the volumetric flow of fluid into the tubular part.

7. An inflow control device according to claim 6, wherein the flow control valve is positioned upstream of the aperture provided in the wall of the tubular part.

8. An inflow control device according to claim 1, wherein the hollow valve member comprises a key hole for cooperating with a key tool adapted to rotate the hollow valve member between the open position and a closed position.

9. An inflow control device according to claim 1, further comprising sealing elements provided in the wall of the tubular part encircling the apertures, the sealing elements being adapted to provide a sealing effect between the tubular part and the hollow valve member.

10. An inflow control device according to claim 1, wherein the surface of the hollow valve member and/or the surface of the recess are/is provided with a coating comprising carbon.

11. An inflow control device according to claim 1, further comprising a screen module comprising a screen, the screen module being arranged in continuation of the tubular part as part of the well tubular structure.

12. A method of assembling an inflow control device according to claim 1, comprising:

positioning the first valve part in the recess inside the tubular part, rotating the first valve part in a plane extending in the longitudinal direction, positioning the second valve part in the recess inside the tubular part, and rotating the second valve part in a plane extending in the longitudinal direction, whereby the first valve part and the second valve part engage to form a hollow valve member.

13. A completion system comprising an inflow control device according to claim 1 and a well tubular structure.

14. A completion system according to claim 13, wherein the well tubular structure comprises a casing module comprising an annular barrier or packer, an injection module for injecting a fluid into the surrounding formation, and an inflow control module comprising inflow control modules comprising sliding sleeves.

* * * * *